US009640314B2

(12) United States Patent
Singh et al.

(10) Patent No.: US 9,640,314 B2
(45) Date of Patent: May 2, 2017

(54) OUTDOOR DRY-TYPE TRANSFORMER

(75) Inventors: Bandeep Singh, Wytheville, VA (US); Thomas Hartmann, Rural Retreat, VA (US); William E. Pauley, Jr., Bland, VA (US)

(73) Assignee: ABB Schweiz AG, Baden (CH)

( * ) Notice: Subject to any disclaimer, the term of this patent is extended or adjusted under 35 U.S.C. 154(b) by 0 days.

(21) Appl. No.: 13/079,490

(22) Filed: Apr. 4, 2011

(65) Prior Publication Data

US 2011/0248808 A1 Oct. 13, 2011

Related U.S. Application Data

(60) Provisional application No. 61/321,852, filed on Apr. 7, 2010.

(51) Int. Cl.

| | |
|---|---|
| ***H01F 30/12*** | (2006.01) |
| ***H01F 27/02*** | (2006.01) |
| ***H01F 27/32*** | (2006.01) |
| ***H01F 27/23*** | (2006.01) |

(52) U.S. Cl.

CPC ..... *H01F 27/327* (2013.01); *H01F 27/23* (2013.01); *H01F 30/12* (2013.01); *H01F 2027/328* (2013.01)

(58) Field of Classification Search

CPC ..... H01F 2027/328
USPC ..... 336/90–96
See application file for complete search history.

(56) References Cited

U.S. PATENT DOCUMENTS

| | | | | |
|---|---|---|---|---|
| 1,749,252 | A * | 3/1930 | Le Blond | H01F 27/06 174/45 R |
| 2,036,305 | A * | 4/1936 | Snyder | 323/340 |
| 2,761,643 | A * | 9/1956 | Ward | H01F 27/06 211/107 |
| 2,910,261 | A * | 10/1959 | Ward et al. | 248/230.5 |
| 2,998,476 | A * | 8/1961 | Nix | H01F 27/06 174/139 |
| 3,073,891 | A * | 1/1963 | Barengoltz | 174/161 R |
| 3,213,397 | A * | 10/1965 | Broverman | 336/60 |
| 3,249,903 | A * | 5/1966 | Clark | 336/94 |
| 3,258,524 | A * | 6/1966 | Walling et al. | 174/161 R |
| 3,260,974 | A * | 7/1966 | Specht et al. | 336/90 |
| 3,333,221 | A * | 7/1967 | Lockie | H01F 27/402 252/62.51 R |
| 3,371,299 | A * | 2/1968 | Radkowski et al. | 336/57 |

(Continued)

FOREIGN PATENT DOCUMENTS

| | | |
|---|---|---|
| EP | 2075806 A1 | 7/2009 |
| GB | 900721 A | 7/1962 |

(Continued)

*Primary Examiner* — Elvin G Enad
*Assistant Examiner* — Ronald Hinson
(74) *Attorney, Agent, or Firm* — Taft Stettinius & Hollister LLP

(57) ABSTRACT

A three-phase dry distribution transformer adapted for mounting outdoors on a pad or to a utility pole. The distribution transformer includes one or more winding assemblies mounted to a ferromagnetic core. Each winding assembly includes a low voltage winding and a high voltage winding. In each winding assembly, an encasement comprised of an insulating resin encapsulates the low voltage and high voltage windings. The encasement includes a body and a pair of high voltage bushings and a pair of low voltage bushing.

19 Claims, 7 Drawing Sheets

(56) References Cited

U.S. PATENT DOCUMENTS

| | | | | | |
|---|---|---|---|---|---|
| 3,396,355 | A | * | 8/1968 | Hochart et al. | 336/58 |
| 3,569,884 | A | * | 3/1971 | Wright | 336/96 |
| 3,662,461 | A | | 5/1972 | Lake et al. | |
| 3,734,438 | A | * | 5/1973 | Kautz | H02B 5/02 211/107 |
| 3,810,059 | A | * | 5/1974 | Jost | 337/25 |
| 3,996,544 | A | | 12/1976 | Mori et al. | |
| 4,025,824 | A | * | 5/1977 | Cheatham | 361/601 |
| 4,129,938 | A | * | 12/1978 | Hagenbucher | 29/605 |
| 4,142,178 | A | * | 2/1979 | Whyte et al. | 307/149 |
| 4,236,134 | A | * | 11/1980 | Alber et al. | 336/96 |
| 4,239,077 | A | * | 12/1980 | Dixon et al. | 156/273.5 |
| 4,336,490 | A | * | 6/1982 | Lewis | 323/305 |
| 4,488,134 | A | | 12/1984 | Pfeiffer | |
| 4,492,314 | A | * | 1/1985 | Avery | 220/646 |
| 4,846,163 | A | * | 7/1989 | Bannister et al. | 228/124.1 |
| 4,980,515 | A | | 12/1990 | Sakuma et al. | |
| 5,162,726 | A | * | 11/1992 | Swanson et al. | 324/127 |
| 5,267,393 | A | | 12/1993 | Purohit et al. | |
| 5,516,992 | A | * | 5/1996 | Dohnal et al. | 200/11 TC |
| 5,588,201 | A | | 12/1996 | Alber et al. | |
| 5,645,004 | A | * | 7/1997 | Holland | 114/211 |
| 6,221,297 | B1 | | 4/2001 | Lanoue et al. | |
| 6,223,421 | B1 | | 5/2001 | Lanoue et al. | |
| 6,485,659 | B1 | * | 11/2002 | Goedde et al. | 252/570 |
| 6,806,803 | B2 | * | 10/2004 | Hopkinson | H01F 27/306 336/12 |
| 6,930,579 | B2 | | 8/2005 | Radford et al. | |
| 7,023,312 | B1 | | 4/2006 | Lanoue et al. | |
| 7,647,692 | B2 | | 1/2010 | Lanoue et al. | |
| 7,688,170 | B2 | | 3/2010 | Pauley, Jr. et al. | |
| 7,719,397 | B2 | | 5/2010 | Pauley, Jr. et al. | |
| 7,795,877 | B2 | * | 9/2010 | Radtke et al. | 324/530 |
| 7,834,736 | B1 | * | 11/2010 | Johnson et al. | 336/229 |
| 7,886,424 | B2 | | 2/2011 | Pauley, Jr. et al. | |
| 7,905,009 | B2 | | 3/2011 | Pauley, Jr. et al. | |
| 2004/0217836 | A1 | * | 11/2004 | Archambault et al. | 336/182 |
| 2006/0017537 | A1 | * | 1/2006 | Colmenero et al. | 336/147 |
| 2006/0152878 | A1 | * | 7/2006 | Ramarge et al. | 361/118 |
| 2008/0211611 | A1 | | 9/2008 | Hanov | |
| 2009/0072940 | A1 | * | 3/2009 | Yang et al. | 336/57 |
| 2010/0328002 | A1 | * | 12/2010 | Yargole et al. | 336/61 |

FOREIGN PATENT DOCUMENTS

| | | | |
|---|---|---|---|
| WO | 01/08175 | A1 | 2/2001 |
| WO | 2008012757 | A1 | 10/2008 |
| WO | 2009104197 | A1 | 8/2009 |
| WO | 2011126991 | A1 | 10/2011 |

* cited by examiner

OUTDOOR DRY-TYPE TRANSFORMER

CROSS-REFERENCE TO RELATED APPLICATION

This application claims the benefit of U.S. provisional patent application No. 61/321,852 filed on Apr. 7, 2010, which is hereby incorporated by reference in its entirety.

BACKGROUND OF THE INVENTION

The present invention relates to transformers and more particularly to distribution transformers for outdoor mounting.

Power is often provided from utilities to residences and small businesses through distribution transformers disposed outdoors (not in a building). Such outdoor transformers may be mounted on a pad or on a utility pole. Conventionally, such outdoor distribution transformers include a core and coil assembly disposed inside a housing. If the transformer is liquid-filled, the housing may enclose or include a tank filled with a dielectric fluid for cooling the core and coil assembly. If the transformer is a dry transformer, the housing may be a ventilated structure that permits air to flow in and out, while providing protection from sun and ultraviolet (UV) rays, rain, snow, etc. The housing for a conventional outdoor transformer increases the size and cost of the transformer. In addition, for liquid-filled transformers, anomalous events, such as lightning strikes and traffic accidents, can result in the tank being compromised and the dielectric fluid spilling into the surrounding area, which can present environmental issues. For this and other reasons it would be desirable to provide a dry-type distribution transformer that is adapted for mounting outdoors, but does not require a housing. The present invention is directed to such a dry-type distribution transformer.

SUMMARY OF THE INVENTION

In accordance with the present invention, a distribution transformer adapted for outdoor use is provided and includes one or more winding assemblies mounted to a ferromagnetic core that is coated with one or more protective coatings. Each winding assembly includes a low voltage winding and a high voltage winding encapsulated in an encasement. Each encasement includes an insulating resin and has a body with a central passage extending therethrough and a pair of high voltage bushings and a pair of low voltage bushings extending outwardly from the body.

BRIEF DESCRIPTION OF THE DRAWINGS

The features, aspects, and advantages of the present invention will become better understood with regard to the following description, appended claims, and accompanying drawings where:

DETAILED DESCRIPTION OF ILLUSTRATIVE EMBODIMENTS

Figure 1:
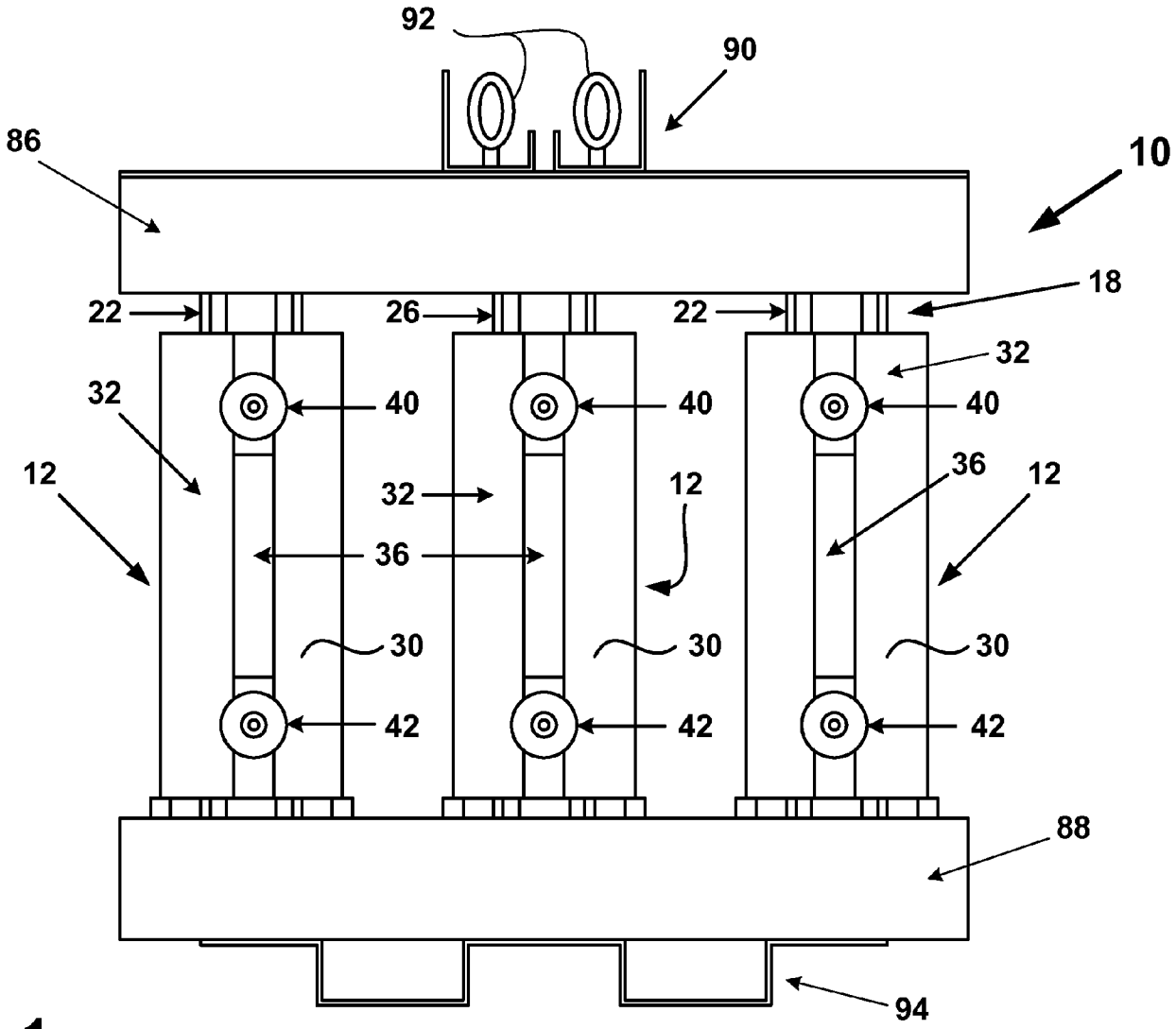
FIG. 1 is a front elevational view of a transformer embodied in accordance with the present invention.

It should be noted that in the detailed description that follows, identical components have the same reference numerals, regardless of whether they are shown in different embodiments of the present invention. It should also be noted that in order to clearly and concisely disclose the present invention, the drawings may not necessarily be to scale and certain features of the invention may be shown in somewhat schematic form.

The present invention is directed to a dry-type, distribution transformer adapted for outdoor mounting without the need to be enclosed inside a protective housing. The transformer may be single phase or three phase and may be mounted to a utility pole or to a pad on the ground.

Figure 2:
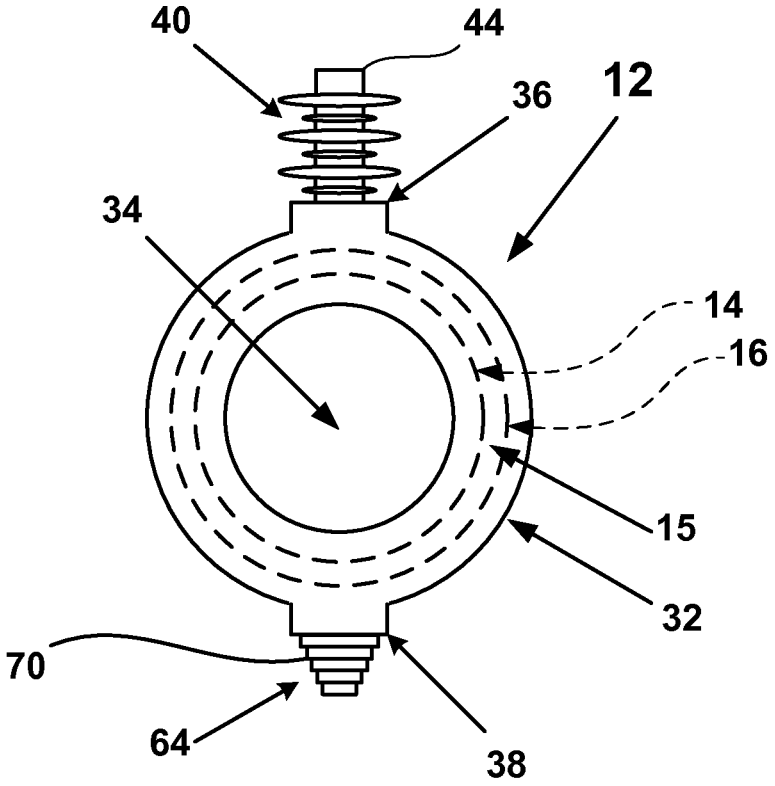
FIG. 2 is a top plan view of one of three winding assemblies of the transformer.

Referring now to FIGS. 1 and 2, a three-phase transformer 10 constructed in accordance with the present invention is shown. The transformer 10 comprises three winding assemblies 12 (one for each phase) mounted to a core 18. The core 18 is comprised of ferromagnetic metal and is generally rectangular in shape. The core 18 includes a pair of outer legs 22 extending between a pair of yokes 24. An inner leg 26 also extends between the yokes 24 and is disposed between and is substantially evenly spaced from the outer legs 22. The winding assemblies 12 are mounted to and disposed around the outer legs 22 and the inner leg 26, respectively. Each winding assembly 12 comprises a low voltage (LV) winding 14 and a high voltage (HV) winding 16, each of which may be cylindrical or rectangular in shape. In each winding assembly 12, the HV winding 16 and the LV winding 14 are mounted concentrically, with the LV winding 14 being disposed within and radially inward from the HV winding 16. Each of the winding assemblies 12 is disposed inside an encasement 30 formed from one or more resins 15, as will be described more fully below. Each winding assembly 12 is cast into the resin(s) 15 during a casting process so as to be encapsulated within the encasement 30.

The transformer 10 may have a kVA rating in a range of from about 26.5 kVA to about 15,000 kVA. The voltages of the HV windings 16 may be in a range of from about 600 V to about 35 kV and the voltage of the LV windings 14 may be in a range of from about 120 V to about 15 kV. In those embodiments where the transformer 10 provides power to residences and small businesses, the transformer 10 may be a step-down transformer that receives an input voltage and steps it down to a lower, output voltage. In these embodiments, the transformer 10 may have a rating from about 50 kVA to about 1500 kVA, with an input voltage in a range from 2,400 to 34,500 Volts and an output voltage in a range from 120 to 600 Volts.

Each encasement 30 includes a main body 32 with a central passage 34 extending therethrough. Depending on the construction of the winding assembly 12, the main body 32 may be cylindrical (as shown) or rectangular. A high voltage (HV) dome 36 and a low voltage (LV) dome 38 are integrally joined to the main body 32 and extend in the axial direction of the main body 32. The HV dome 36 and the LV dome 38 may be disposed on opposing sides of the main body 32, i.e., at an angle of 180° to each other. Alternately, the HV dome 36 and the LV dome 38 may be disposed closer together, such as at an angle of 90° to each other.

Figure 5:
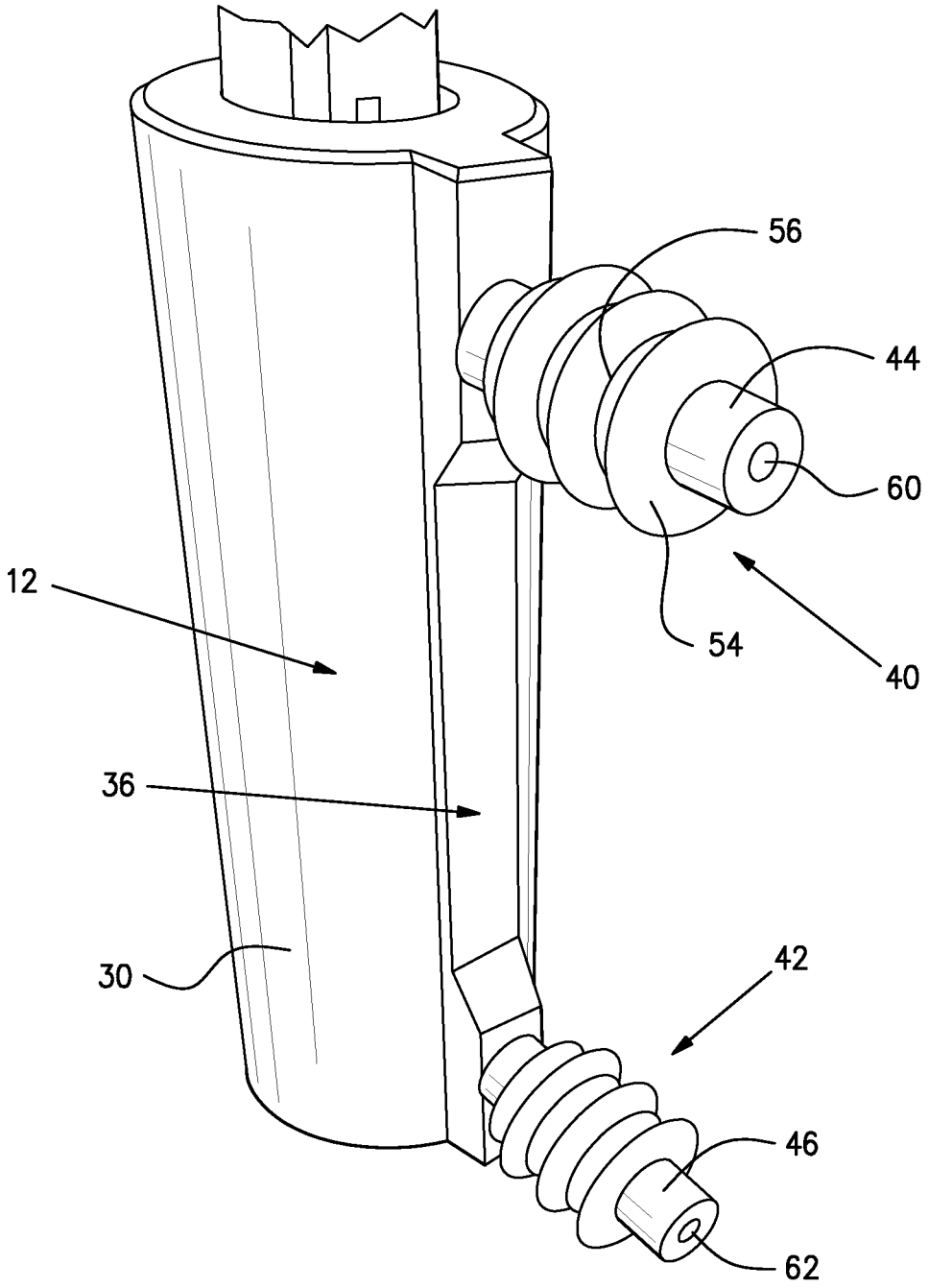
FIG. 5 is a front perspective view of one of the three winding assemblies of the transformer.

With particular reference to FIGS. 2 and 5, a first high voltage (HV) bushing 40 and a second high voltage (HV)

bushing 42 extend from the HV dome 36. The first HV bushing 40 includes a body 44 integrally joined to the HV dome 36 and the second HV bushing 42 includes a body 46 integrally joined to the HV dome 36. The bodies 44, 46 of the first and second HV bushings 40, 42 may each include large diameter sheds 54 and small diameter sheds 56 arranged in an alternating manner, as shown. Alternately, the bodies 44, 46 may include only large diameter sheds 54. First and second high voltage (HV) conductors 60, 62 extend through the bodies 44, 46, respectively.

Figure 4:
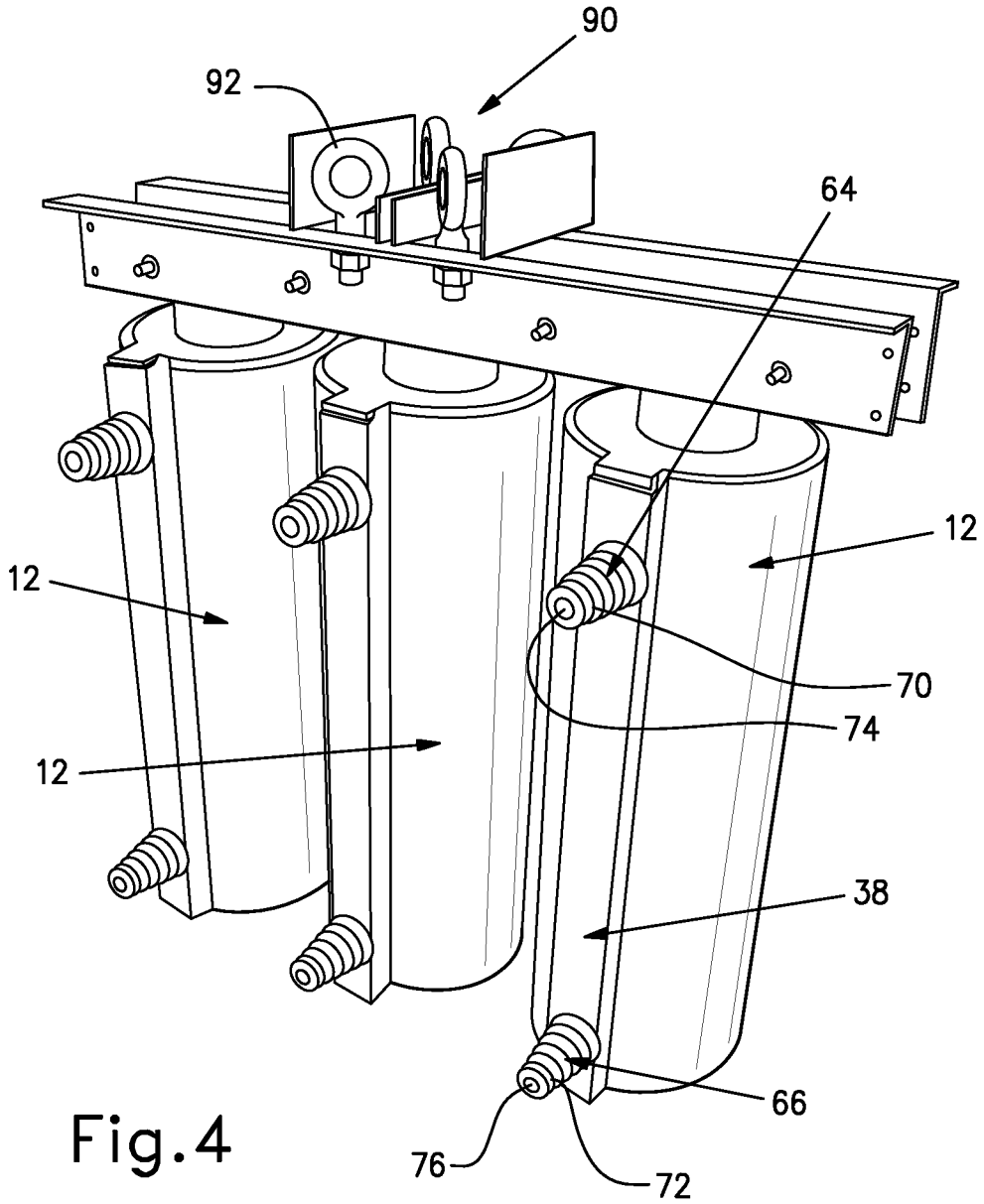
FIG. 4 is a rear perspective view of the transformer.

With particular reference to FIGS. 2 and 4, a first low voltage (LV) bushing 64 and a second low voltage (LV) bushing 66 extend from the LV dome 38. The first LV bushing 64 includes a body 70 integrally joined to the LV dome 38 and the second LV bushing 66 includes a body 72 integrally joined to the LV dome 38. The bodies 70, 72 may each be comprised of a plurality of cylindrical sections, decreasing in diameter as the body extends outward, thereby giving the body a generally frusto-conical shape, as shown. Alternately, the bodies 70, 72 may have different shapes. First and second low voltage (LV) conductors 74, 76 extend through the bodies 70, 72, respectively.

The main body 32, the HV and LV domes 36, 38, the bodies 44, 46 of the first and second HV bushings 40, 42 and the bodies 70, 72 of the first and second LV bushings 64, 66 are all integrally formed together during the casting process.

Figure 3:
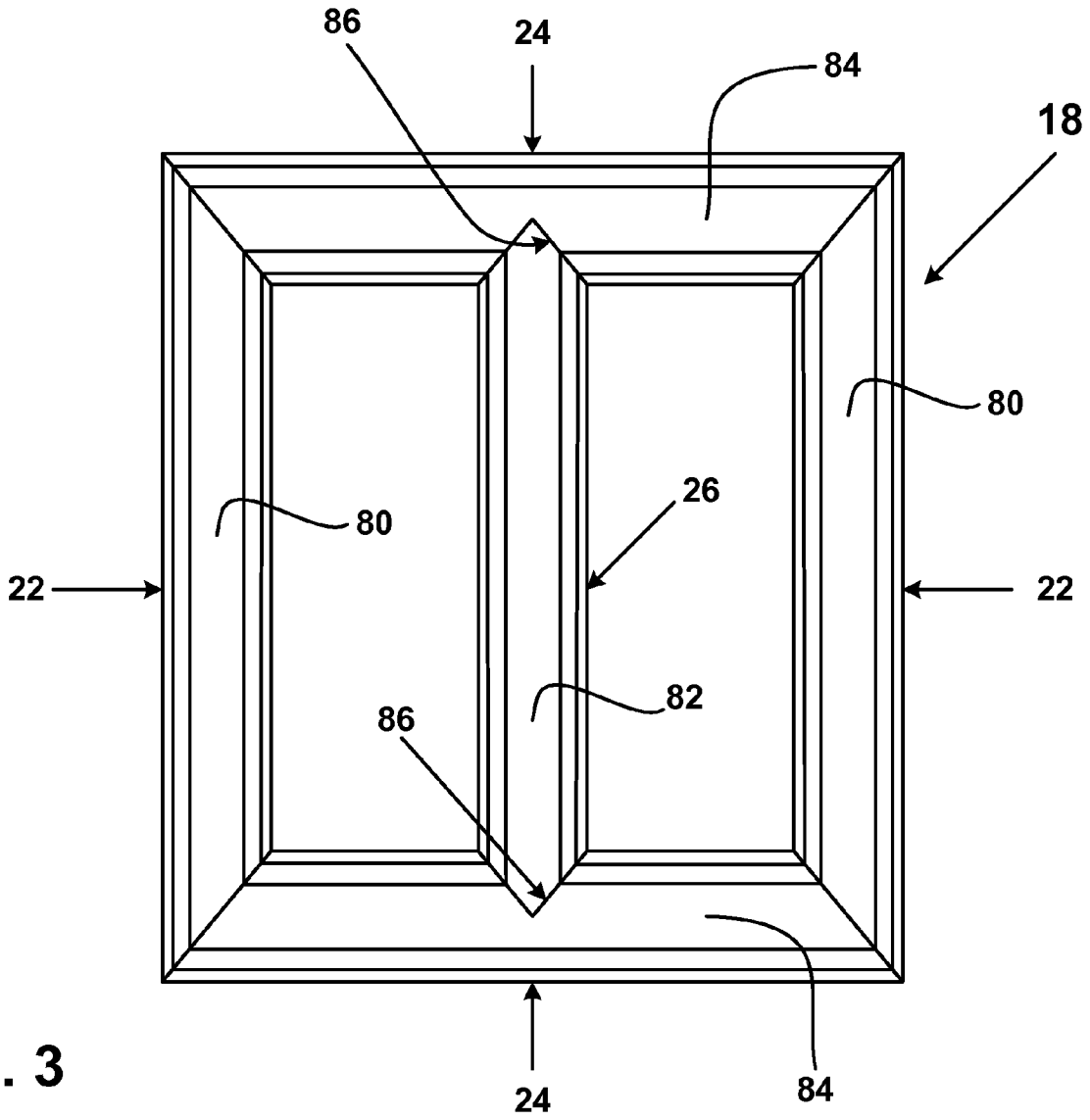
FIG. 3 is a front elevational view of a core of the transformer.

Referring now to FIG. 3, each component of the core 18 is formed from a stack of plates, each of which may be composed of grain-oriented silicon steel and have a thickness in a range of from about 7 mils to about 14 mils. Thus, each outer leg 22 comprises a stack of outer leg plates 80, the inner leg 26 comprises a stack of inner leg plates 82 and each yoke 24 comprises a stack of yoke plates 84. The outer leg plates 80 and the yoke plates 84 have mitered ends so as to form mitered joints therebetween, respectively. The yoke plates 84 further have V-shaped notches formed therein so that the stacked yoke plates form V-shaped grooves 86 in the yokes 24, respectively. The ends of the inner leg plates 82 are pointed so that ends of the inner leg 26 are received in the grooves 86 of the yokes 24, respectively.

The stack of outer leg plates 80, the stack of inner leg plates 82 and the stack of yoke plates 84 are each arranged in groups. In one exemplary embodiment of the present invention, the groups each comprise seven plates. Of course, groups of different numbers may be used. The groups of the outer leg plates 80 correspond to the groups of the yoke plates 84, which, in turn, correspond to the groups of the inner leg plates 82. The outer leg plates 80, the inner leg plates 82 and the yoke plates 84 may be cut and arranged so that the joints between the yokes 24 and the inner leg 26 and the outer legs 22 are multi-step lap joints.

As shown, the outer legs 22, the inner leg 26 and the yokes 24 may each have a cruciform cross-section that approximates a circle. The cruciform cross-sections of these components of the core 18 are formed by providing the constituent plates of the components with varying widths. For example, each of the components may have sections of varying widths, wherein each section comprises a plurality of groups of plates. Alternately, the outer leg plates 80, the inner leg plates 82 and the yoke plates 84 may all have the same width so that the cross-sections of the outer legs 22, the inner leg 26 and the yokes 24 are each rectangular.

Although the core 18 is shown and described as having a rectangular, stacked construction, it should be appreciated that other core constructions may be used, such as a wound core construction.

Referring back to FIG. 1, an upper one of the yokes 24 is secured between a pair of upper clamp structures 86 and a lower one of the yokes 24 is secured between a pair of lower clamp structures 88. A mounting structure 90 is secured to, and extends between, the upper clamp structures 86. The mounting structure 90 includes one or more eyebolts 92, which may be used for moving the transformer 10 and/or mounting the transformer 10 to a utility pole. A corrugated base 94 may be secured to the bottom of the lower clamp structures 88.

The core 18 and the upper and lower clamp structures 86, 88 are coated with one or more layers of protective coatings to protect the core 18 and the upper and lower clamp structures 86, 88 from corrosion. In one embodiment of the present invention, the core 18 and the upper and lower clamp structures 86, 88 are provided with three coating layers: a primer coat layer, a base coat layer and a topcoat layer. The primer coat layer is a zinc-rich primer coat layer that comprises at least about 70%, more particularly about 80% by weight of zinc in the dry film. The primer coat layer may comprise an epoxy polyamide binder and zinc powder filler. The base coat layer is an epoxy coating and may also comprise an epoxy polyamide binder. The topcoat layer is hydrophobic and may comprise an aliphatic polyurethane, an epoxy, silicone rubber or another type of polyurethane.

Figure 6:
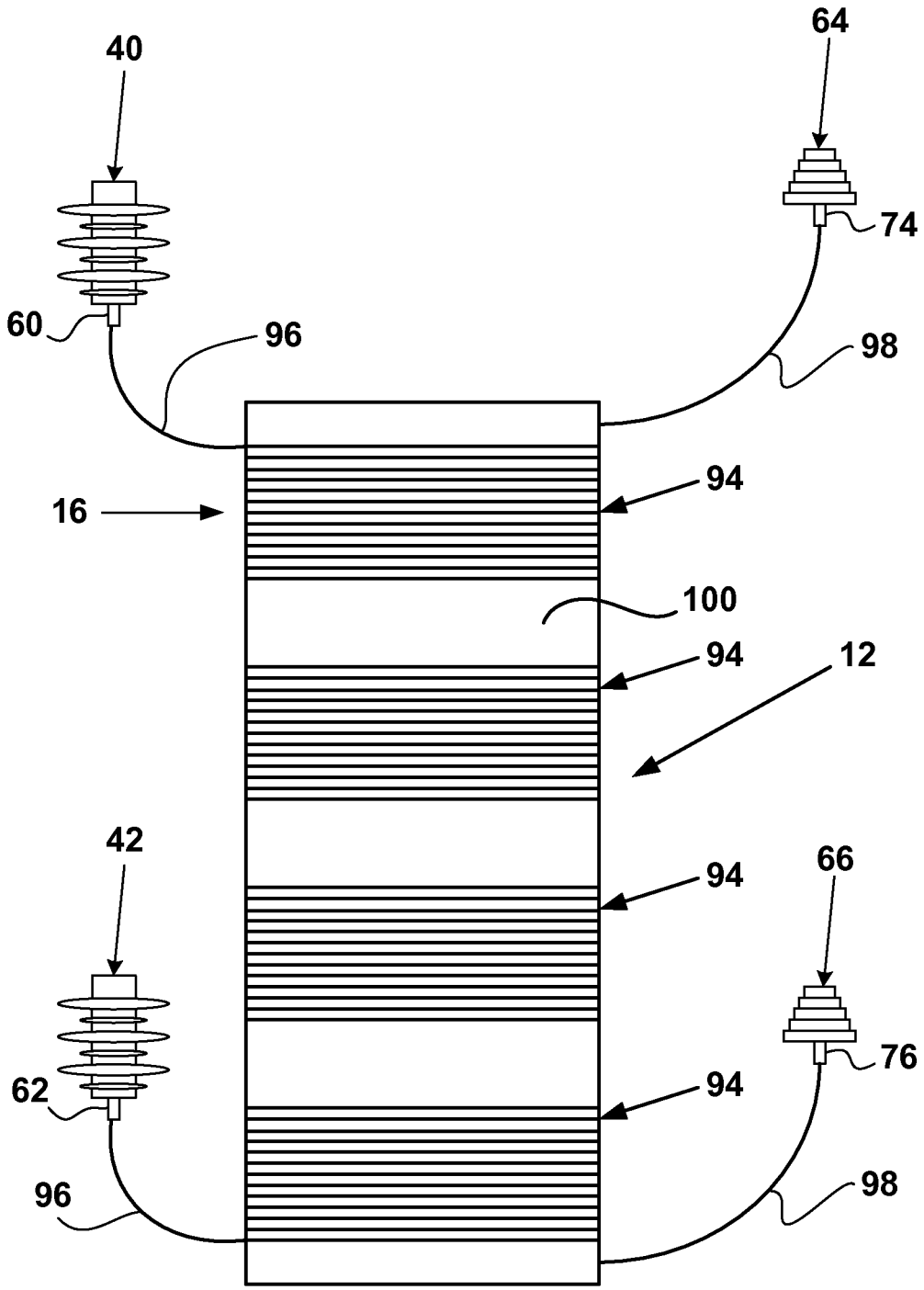
FIG. 6 is a schematic view of one of the three winding assemblies before it is encapsulated in an encasement.
Figure 7:
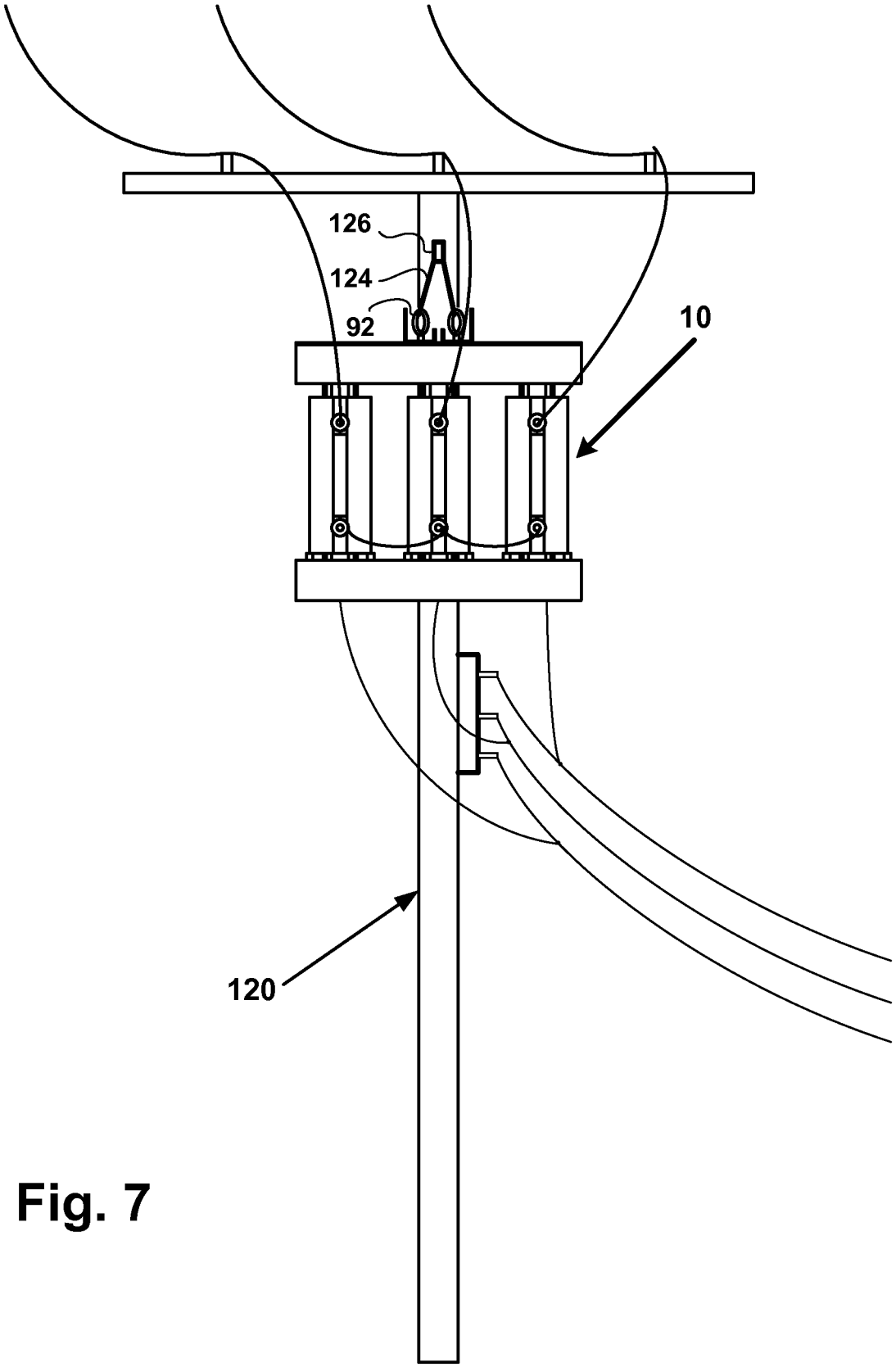
FIG. 7 is an elevational view of the transformer mounted to a utility pole.

Referring now to FIG. 6, there is shown one of the winding assemblies 12 before it has been encapsulated within the encasement 30. The HV winding 16 comprises a plurality of spaced-apart winding segments 94 electrically connected together in series. The winding segments 94 are formed segment by segment and are wound over the LV winding 14 so as to be coaxial therewith. In the shown embodiment, there are four winding segments 94. It should be appreciated, however, that a different number of winding segments may be provided without departing from the scope of the present invention. Instead of four winding segments 94, there may be two, three, five, six or other number of winding segments 94. Each winding segment 94 may be formed using a barrel or layer winding technique, wherein a conductor 96 is wound in one or more concentric conductor layers connected in series, with the turns of each layer being wound side by side along the axial length of segment 94. In most embodiments, there are 5-40, more particularly 11-14 conductor layers. A layer of insulation material (such as an aramid polymer paper) is disposed between each pair of conductor layers. Although not shown, an outer layer of insulation material may also be disposed over the outermost conductor layer. The conductor 96 may be wire with a rectangular or circular cross-section and is insulated with paper or enamel lacquer. The conductor 96 may be comprised of aluminum or copper. Ends of the conductor 96 (constituting ends of the HV winding 16) are connected to the first and second HV conductors 60, 62 of the first and second HV bushings 40, 42, respectively.

The LV winding 14 extends uninterrupted under all of the winding segments 94. The LV winding 14 is formed using a layer winding technique with two conductors 98. The conductors 98 are connected in parallel and are wound together along the axial length of the LV winding 14 to form a plurality of turns, with each turn comprising the two conductors 98. A plurality of layers of the wound double conductors 98 is formed. In most embodiments, there are between one and four layers. A layer of insulation material (such as an aramid polymer paper) may be disposed between each pair of conductor layers. Each of the conductors 98 may be copper or aluminum wire with a rectangular or circular cross-section and is insulated with paper or enamel lacquer. Ends of the conductors 98 (constituting ends of the LV winding 14) are connected to the first and second LV conductors 74, 76 of the first and second LV bushings 64, 66, respectively.

An insulation or high-low barrier 100 is formed over the outermost conductor layer of the LV winding 14. The high-low barrier 100 may be composed of a relatively rigid dielectric plastic. Alternately, the high-low barrier 100 may be formed from a plurality of layers of a flexible insulating sheet or tape wound over the outermost conductor layer. The insulating sheet or tape may be composed of an insulating material, such as a polymeric paper or Kraft paper. The thickness of the high-low barrier 100 depends on the rating of the transformer 10. The HV winding 16 is wound over the high-low barrier 100. In this manner, the high-low barrier 100 forms part of the winding assembly 12 and adjoins both the LV winding 14 and the HV winding 16.

Each winding assembly 12 may be formed on a winding mandrel of a winding machine. Once the winding assembly has been fully wound, the winding assembly 12 is removed from the winding mandrel and then cast into the insulating resin(s) forming the encasement 30.

The encasement 30 may be formed from a single insulating resin, which is an epoxy resin. In one embodiment, the resin is a cycloaliphatic epoxy resin, still more particularly a hydrophobic cycloaliphatic epoxy resin composition. Such an epoxy resin composition may comprise a cycloaliphatic epoxy resin, a curing agent, an accelerator and filler, such as silanised quartz powder, fused silica powder, or silanised fused silica powder. In one embodiment, the epoxy resin composition comprises from about 50-70% filler. The curing agent may be an anhydride, such as a linear aliphatic polymeric anhydride, or a cyclic carboxylic anhydride. The accelerator may be an amine, an acidic catalyst (such as stannous octoate), an imidazole, or a quaternary ammonium hydroxide or halide.

The encasement 30 may be formed from the resin composition in an automatic pressure gelation (APG) process. In accordance with APG process, the resin composition (in liquid form) is degassed and preheated to a temperature above 40° C., while under vacuum. The winding assembly 12 is placed in a cavity of a mold heated to an elevated curing temperature of the resin. The degassed and preheated resin composition is then introduced under slight pressure into the cavity containing the electrical assembly. Inside the cavity, the resin composition quickly starts to gel. The resin composition in the cavity, however, remains in contact with pressurized resin being introduced from outside the cavity. In this manner, the shrinkage of the gelled resin composition in the cavity is compensated for by subsequent further addition of degassed and preheated resin composition entering the cavity under pressure. After the resin composition cures to a solid, the solid encasement 30 with the winding assembly 12 molded therein is removed from the mold cavity. The encasement 30 is then allowed to fully cure.

It should be appreciated that in lieu of being formed pursuant to an APG process, the encasement 30 may be formed using an open casting process or a vacuum casting process. In an open casting process, the resin composition is simply poured into an open mold containing the winding assembly 12 and then heated to the elevated curing temperature of the resin. In vacuum casting, the winding assembly 12 is disposed in a mold enclosed in a vacuum chamber or casing. The resin composition is mixed under vacuum and introduced into the mold in the vacuum chamber, which is also under vacuum. The mold is heated to the elevated curing temperature of the resin. After the resin composition is dispensed into the mold, the pressure in the vacuum chamber is raised to atmospheric pressure for curing the part in the mold. Post curing can be performed after demolding the part.

In another embodiment of the present invention, the encasement 30 has two layers formed from two different insulating resins, respectively, and is constructed in accordance with PCT Application No.: WO2008127575, which is hereby incorporated by reference. In this embodiment, the encasement 16 comprises an inner layer or shell and an outer layer or shell. The outer shell is disposed over the inner shell and is coextensive therewith. The inner shell is more flexible (softer) than the outer shell, with the inner shell being comprised of a flexible first resin composition, while the outer shell being comprised of a rigid second resin composition. The first resin composition (when fully cured) is flexible, having a tensile elongation at break (as measured by ASTM D638) of greater than 5%, more particularly, greater than 10%, still more particularly, greater than 20%, even still more particularly, in a range from about 20% to about 100%. The second resin composition (when fully cured) is rigid, having a tensile elongation at break (as measured by ASTM D638) of less than 5%, more particularly, in a range from about 1% to about 5%. The first resin composition of the inner shell may be a flexible epoxy composition, a flexible aromatic polyurethane composition, butyl rubber, or a thermoplastic rubber. The second resin composition of the outer shell is a cycloaliphatic epoxy composition, such as that described above. The encasement 30 is formed over the electrical assembly using first and second casting processes. In the first casting process, the inner shell is formed from the first resin composition in a first mold. In the second casting process, the intermediate product comprising the winding assembly 12 inside the inner shell is placed in a second mold and then the second resin composition is introduced into the second mold. After the second resin composition (the outer shell) cures for a period of time to form a solid, the encasement 30 with the winding assembly 12 disposed therein is removed from the second mold. The outer shell is then allowed to fully cure.

It should be appreciated that with each winding assembly 12 having the construction described above, there are no open spaces between the LV winding 14 and the HV winding 16, i.e., the LV winding 14 and the HV winding 16 are separated only by the high-low barrier 100. In addition, there are no cooling spaces or ducts between any of the conductor layers of the LV and HV windings 14, 16. The ends of the encasement 30 are solid, with no openings or passages therein except for the central passage 34.

The transformer 10 is adapted to be mounted to a utility pole (such as utility pole 120) that extends upright from the ground and supports power lines carrying power from a power generation plant. The transformer 10 may be mounted to the utility pole 120 in a variety of different ways. The transformer 10 may be mounted to the utility pole 120 by one or more cables 124 fastened between the eyebolts 92 and a bracket 126 secured to the utility pole 120. The cables 124 may secured to hooks that engage the eyebolts 92 and/or the bracket 126.

When the transformer 10 is mounted to the utility pole 120 as described above, the transformer 10 is elevated above the ground. Power lines carrying power from a power generating station are supported by the utility pole 120 and are connected to the first and second HV conductors 60, 62 of the first and second HV bushings 40, 42. The HV windings 16 are shown connected together in a Wye configuration. Alternately, the HV windings 16 may be connected together in a Delta configuration. The LV windings 14 may also be connected together in a Delta or Wye configuration. The combination of the transformer 10 and the utility pole 120 forms a power distribution installation that can provide power to a residence or a small business.

Of course, as set forth above, the transformer 10 may be mounted to a pad on the ground, instead of a utility pole. In either type of mounting, the transformer 10 is adapted for mounting outdoors (outside of a building) without being enclosed in a housing or any other type of protective enclosure and where the transformer 10 will be exposed directly to the elements, i.e., sun and UV rays, rain, snow, wind, etc.

Although only a three-phase transformer has been shown and described, the present invention is not limited to a three-phase transformer. A single-phase transformer constructed in accordance with the present invention may also be provided. A single-phase transformer may have substantially the same construction as the transformer 10, except for the differences described below. The core of the single-phase transformer does not have the inner leg 26. In addition, the yoke plates 84 do not have the V-shaped notches and are shorter in length so that the outer legs 22 are positioned closer together. Only one winding assembly 12 is provided and is mounted to one of the outer legs 22. Of course, the upper and lower clamp structures 86, 88 are shorter in length to correspond to the shortened yokes 24.

It is to be understood that the description of the foregoing exemplary embodiment(s) is (are) intended to be only illustrative, rather than exhaustive, of the present invention. Those of ordinary skill will be able to make certain additions, deletions, and/or modifications to the embodiment(s) of the disclosed subject matter without departing from the spirit of the invention or its scope, as defined by the appended claims.

What is claimed is:

1. A transformer system comprising:

a ferromagnetic core including an upper yoke and a lower yoke, said upper yoke being secured between a pair of upper clamps, and wherein a mounting structure is secured to and extends between said upper clamps, said mounting structure being structured to affix said distribution transformer to a pole;

a winding assembly mounted to said core and comprising a low voltage winding and a high voltage winding, both of said low and high voltage windings being encapsulated in an encasement, wherein in said winding assembly there are no cooling spaces between successive layers of said high and low voltage windings, and wherein said encasement comprises an insulating resin that includes a main body having a central passage comprising the only opening therethrough, said main body being cast around said winding assembly in order to integrally form the following components with said main body:

a high voltage dome and a low voltage dome that each extend in an axial direction along said main body;

a pair of high voltage bushings integrally formed with and extending outwardly from said high voltage dome at opposite ends of said high voltage dome, each of said high voltage bushings including a body extending from said high voltage dome and a plurality of sheds extending outwardly from and integrally formed with said body; and a pair of low voltage bushings integrally formed with and extending outwardly from said low voltage dome at opposite ends of said low voltage dome, each of said pair of low voltage bushings including a body with a plurality of cylindrical sections that decrease in diameter as the body extends outwardly from said low voltage dome.

2. The transformer system of claim 1, wherein said low voltage winding and said high voltage winding are concentric.

3. The transformer system of claim 1, wherein said low voltage winding and said high voltage winding are each cylindrical.

4. The transformer system of claim 1, wherein said low voltage winding is disposed inside said high voltage winding.

5. The transformer system of claim 1, wherein said high voltage winding comprises a plurality of winding segments, said plurality of winding segments being separated from each other and electrically connected in series.

6. The transformer system of claim 1, wherein each winding assembly further comprises a high-low barrier disposed between and adjoining both said low voltage windings and said high voltage windings.

7. The transformer system of claim 1, wherein said high-low barrier comprises a plurality of layers of a flexible insulating material.

8. A three-phase distribution transformer system, comprising:

a ferromagnetic core having a pair of outer legs and an inner leg extending between an upper yoke and a lower yoke, said upper yoke being secured between a pair of upper clamps, and wherein a mounting structure is secured to and extends between said upper clamps, said mounting structure being structured to affix said distribution transformer to a pole; and a winding assembly mounted to each of the inner and outer legs, each said winding assembly comprising a low voltage winding and a high voltage winding encapsulated in an encasement, and there are no cooling spaces between said high voltage winding and said low voltage winding, and wherein each encasement comprises an insulating resin that forms a main body having a central passage comprising the only opening therethrough, said main body being cast around each said winding assembly in order to integrally form the following components with said main body:

a high voltage dome and a low voltage dome that each extend in an axial direction along said maid main body;

a pair of high voltage bushings integrally formed with and extending outwardly from said high voltage dome at opposite ends of said high voltage dome, each of said high voltage bushings including a body extending from said high voltage dome and a plurality of sheds extending outwardly from and integrally formed with said body and a high voltage conductor extending through said body that is connected with said high voltage winding; and a pair of low voltage bushings integrally formed with and extending outwardly from said low voltage dome at opposite ends of said low voltage dome, each of said pair of low voltage bushings including a body with a plurality of cylindrical sections and a low voltage conductor extending through said body that is connected with said low voltage winding.

9. The three phase distribution transformer system of claim 8, wherein in each winding assembly, said low voltage winding and said high voltage winding are concentric.

10. The three phase distribution transformer system of claim 8, wherein in each winding assembly, said low voltage winding and said high voltage winding are each cylindrical.

11. The three phase distribution transformer system of claim 8, wherein in each winding assembly, said low voltage winding is disposed inside said high voltage winding.

12. The three phase distribution transformer system of claim 8, wherein in each winding assembly, said high voltage winding comprises a plurality of winding segments, said plurality of winding segments being separated from each other and electrically connected in series.

13. The transformer system of claim 1, wherein said insulation resin is a cycloaliphatic epoxy resin.

14. The three phase distribution transformer system of claim 8, wherein said insulation resin is a cycloaliphatic epoxy resin.

15. The transformer system of claim 1, wherein said high low barrier comprises a rigid dielectric plastic.

16. The transformer system of claim 1, wherein said transformer system of claim 1 is a three phase transformer system and said winding assembly is a first winding assembly, and wherein said transformer system further comprises a second winding assembly and a third winding assembly mounted to said core.

17. The transformer system of claim 1, wherein said lower yoke is secured between a pair of lower clamps.

18. The three phase distribution transformer system of claim 8, wherein said high low barrier comprises a rigid dielectric plastic.

19. The three phase distribution transformer system of claim 8, wherein said lower yoke is secured between a pair of lower clamps.

* * * * *